US008567325B1

(12) United States Patent
Hlatky et al.

(10) Patent No.: US 8,567,325 B1
(45) Date of Patent: Oct. 29, 2013

(54) WORK TABLE STOWAGE AND SUPPORT FIXTURE

(71) Applicants: John D. Hlatky, Troy, MI (US); Ernestine Elizabeth Hlatky, Troy, MI (US)

(72) Inventors: John D. Hlatky, Troy, MI (US); Ernestine Elizabeth Hlatky, Troy, MI (US)

( * ) Notice: Subject to any disclaimer, the term of this patent is extended or adjusted under 35 U.S.C. 154(b) by 0 days.

(21) Appl. No.: 13/755,538

(22) Filed: Jan. 31, 2013

(51) Int. Cl.
*A47B 3/00* (2006.01)

(52) U.S. Cl.
USPC ..... 108/134; 100/152

(58) Field of Classification Search
USPC ..... 108/152, 42, 48, 99, 162, 179, 108/134–135, 107–110, 147.11, 108/147.16–147.17, 144.11; 211/90.01, 211/90.02, 103, 96, 150
See application file for complete search history.

(56) References Cited

U.S. PATENT DOCUMENTS

| | | | | | |
|---|---|---|---|---|---|
| 593,828 | A | * | 11/1897 | Ank | 108/134 |
| 1,624,862 | A | * | 4/1927 | Elliot | 108/96 |
| 1,698,677 | A | * | 1/1929 | Folkins | 108/39 |
| 1,724,457 | A | * | 8/1929 | Cummings | 108/38 |
| 1,765,168 | A | * | 6/1930 | Laursen | 108/38 |
| 1,796,569 | A | * | 3/1931 | Madsen | 108/39 |
| 1,964,500 | A | * | 6/1934 | Breiding et al. | 108/46 |
| 2,498,428 | A | | 2/1950 | Kruse | |
| 2,584,196 | A | * | 2/1952 | Fernandes | 108/134 |
| 2,612,422 | A | * | 9/1952 | Sarkus | 108/141 |
| 2,686,702 | A | * | 8/1954 | Ventrice | 108/6 |
| 2,881,039 | A | * | 4/1959 | Guzman | 297/163 |
| 2,916,339 | A | * | 12/1959 | Zobac | 108/134 |
| 3,026,158 | A | | 3/1962 | Freeman | |
| 3,080,193 | A | * | 3/1963 | Nimmo | 297/158.4 |
| 3,151,576 | A | * | 10/1964 | Patterson | 108/2 |
| 3,157,379 | A | * | 11/1964 | Platakis | 248/278.1 |
| 4,040,658 | A | * | 8/1977 | Mayol | 297/158.4 |
| 4,488,497 | A | * | 12/1984 | Bevans | 108/147.21 |
| 4,717,105 | A | * | 1/1988 | Stefani | 248/297.31 |
| 4,779,539 | A | | 10/1988 | Stiglich | |
| 4,791,873 | A | | 12/1988 | Towfigh | |
| 4,819,900 | A | * | 4/1989 | Funk | 248/244 |
| 5,236,095 | A | * | 8/1993 | Krizka | 211/96 |
| 5,373,793 | A | * | 12/1994 | Crossman | 108/42 |
| 5,381,738 | A | * | 1/1995 | Meyer | 108/42 |
| 5,535,896 | A | * | 7/1996 | Morgan, Sr. | 211/96 |
| 5,709,044 | A | * | 1/1998 | Atapattu | 38/103 |
| 5,799,962 | A | * | 9/1998 | Barnhart | 280/166 |
| 5,931,102 | A | * | 8/1999 | Grahl | 108/42 |

(Continued)

FOREIGN PATENT DOCUMENTS

| | | |
|---|---|---|
| GB | 2 135 867 A | 9/1981 |

*Primary Examiner* — Hanh V Tran
(74) *Attorney, Agent, or Firm* — Dierker & Associates, P.C.

(57) ABSTRACT

A work table stowage and support fixture includes a bracket to fixedly mount to a substantially vertical wall. A vertical guide has a top end fixed to the bracket and a bottom end distal to the top end fixed to the bracket. A sliding hinge has a hinge body, a bearing disposed on the hinge body to engage the guide and to substantially prevent horizontal motion between the bearing and the guide wherein the bearing is vertically translatable along the guide between a working position and a stowed position, and a hinge pin protruding substantially horizontally from the hinge body wherein the hinge pin has a distal end opposite the hinge body to matingly engage a complementary socket disposed on a work table. A gravity stop is on the bracket to vertically support the sliding hinge when the work table is in a working configuration corresponding to the working position.

17 Claims, 8 Drawing Sheets

(56) References Cited

U.S. PATENT DOCUMENTS

| | | | | |
|---|---|---|---|---|
| 5,979,336 | A * | 11/1999 | Nottingham et al. | 108/42 |
| 6,604,473 | B2 * | 8/2003 | Felsenthal | 108/107 |
| 7,010,833 | B2 | 3/2006 | Duarte et al. | |
| 7,650,671 | B2 | 1/2010 | Lee | |
| 7,658,153 | B1 * | 2/2010 | Patoka | 108/44 |
| 7,716,786 | B2 | 5/2010 | Shen | |
| 7,900,783 | B2 | 3/2011 | Fernandez et al. | |
| 7,975,348 | B2 | 7/2011 | Lin | |
| 8,286,808 | B1 * | 10/2012 | Setlik | 211/96 |
| 2002/0023889 | A1 * | 2/2002 | Larbaletier | 211/150 |
| 2005/0274299 | A1 * | 12/2005 | Bienick et al. | 108/108 |
| 2008/0006183 | A1 * | 1/2008 | Patrick et al. | 108/42 |
| 2009/0020489 | A1 * | 1/2009 | Lin et al. | 211/88.01 |

* cited by examiner

WORK TABLE STOWAGE AND SUPPORT FIXTURE

BACKGROUND

A work table may be useful for laying out material for cutting in a clothing fabrication process. Work tables are also used for many purposes including drawing, supporting parts and tools, and food preparation. In some cases, for example, in a residential garage, it may be desirable to stow a work table against a wall to make floor space available for other purposes when the work table is not being used as a work table. Some work tables may be relatively large and heavy, requiring relatively high effort to maneuver the work table into a working configuration or to stow the work table.

BRIEF DESCRIPTION OF THE DRAWINGS

Features and advantages of examples of the claimed subject matter will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

The present disclosure relates generally to a work table stowage and support fixture. In examples of the present disclosure, a work table may be conveniently maneuvered into a working configuration. The work table may also be conveniently stowed in a stowed configuration against a wall. Examples of the support fixture of the present disclosure allow the working configuration of the work table to be adjusted to a convenient distance from the floor. Examples of the support fixture of the present disclosure accommodate a wide range of work table sizes, thereby generating economies of scale.

Figure 1:
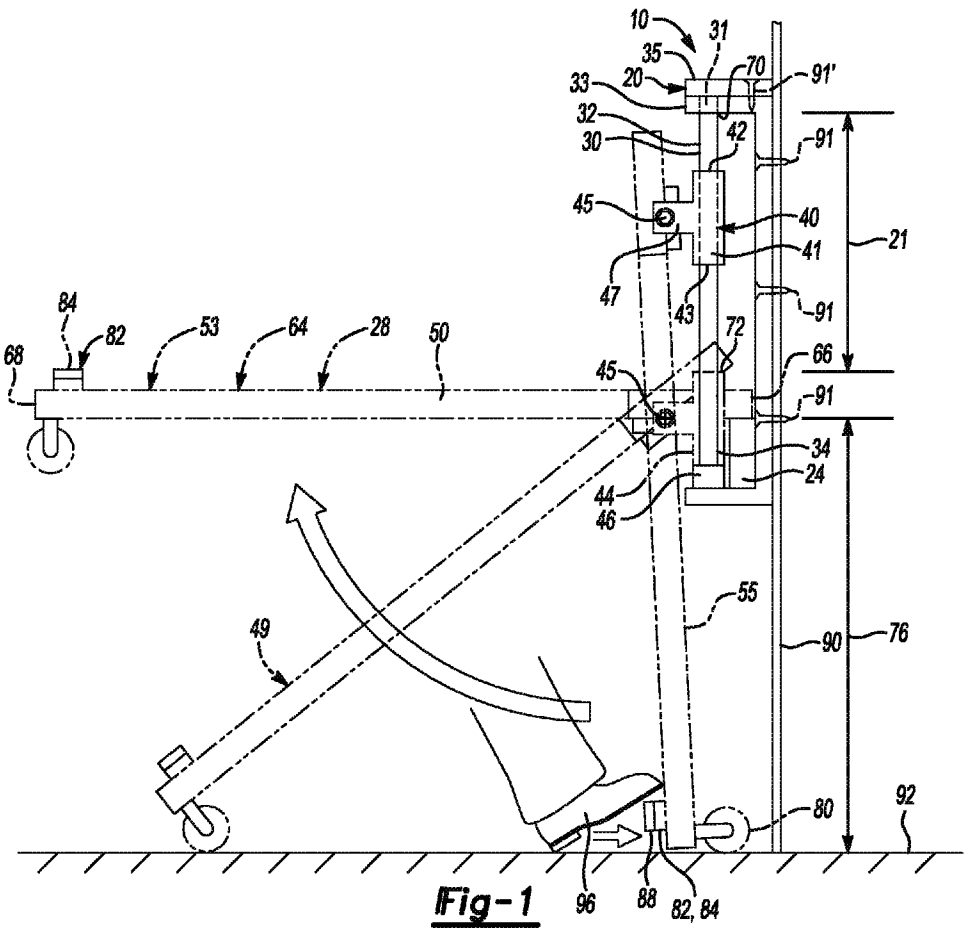
FIG. 1 is a semi-schematic side view of an example of the present disclosure.

FIG. 1 is a semi-schematic side view of an example of a work table stowage and support fixture 10 according to the present disclosure. The stowage and support fixture 10 may include a bracket 20 to be fixedly mounted to a substantially vertical wall 90. The bracket may be mounted to the wall 90 by any suitable method to support the work table 50 and any load (not shown) that may be applied to the work table 50. For example, the bracket 20 may be mounted to the wall 90 using screws 91. In another example, the bracket 20 may be mounted using an adhesive or a hook and loop fastener (not shown). The bracket 20 may include a vertical guide 30 having a top end 32 fixed to the bracket 20 and a bottom end 34 distal to the top end 32 fixed to the bracket 20. In an example, the bracket 20 may have a bumper aperture 31 defined in an upper horizontal flange 33. The bumper aperture 31 is large enough for the vertical guide 30 to slide through the bumper aperture 31. The bumper aperture 31 allows the vertical guide 30 to be removably installed subsequent to mounting the bracket 20 to the wall 90. Installing the bracket 20 without the vertical guide 30 installed, or with the vertical guide 30 removed, may provide tool clearance to facilitate installation of the screws 91 where the vertical guide 30 may otherwise interfere with tool access to the screws 91. In examples having the bumper aperture 31, a cap 35 may be fixedly attached, for example by a screw 91', to the upper horizontal flange 33 cover the bumper aperture 31 and to substantially prevent unintended displacement of the vertical guide 30.

The example of the work table stowage and support fixture 10 depicted in FIG. 1 further includes a sliding hinge 40. The sliding hinge 40 includes a hinge body 41. In an example, the hinge body 41 may be formed from a T-shaped tube connector 47 as depicted in FIG. 1. The sliding hinge 40 further includes a bearing 42 disposed on the hinge body 41 to engage the vertical guide 30 and to substantially prevent horizontal relative motion between the bearing 42 and the vertical guide 30 wherein the bearing 42 is vertically translatable along the vertical guide 30 between a working position 44 and a stowed position 43. A gravity stop 46 may be disposed on the bracket 20 to vertically support the sliding hinge 40 when the sliding hinge 40 is in the working position 44. In the example depicted in FIG. 1, the working position 44 is adjacent to the bottom end 34 of the vertical guide 30. The working position 44 corresponds to a working configuration 53 of the work table 50. Similarly, the stowed position 43 corresponds to the stowed configuration 55 of the work table 50. The working configuration 53 of the work table 50 means that the sliding hinge 40 rests against the gravity stop 46, and the front edge 68 is elevated off of the floor 92 to a convenient height for the work table 50. For example, the work table 50 may have a substantially horizontal working configuration 64 at an elevation that is from about 50 cm (centimeters) to about 125 cm from the floor 92. In other examples, the work table 50 may have a slanted working configuration (not shown). For example, the front edge 68 may be lower than the back edge 66 such that the work surface 28 is inclined with respect to level up to about 45 degrees.

Certain edges and surfaces of the work table 50 are labeled herein for clarity. The following edges and surfaces are referred to herein by labels assigned when the work table 50 is in a substantially horizontal working configuration 64 as shown in FIG. 1. The labels assigned to the edges and surfaces in this paragraph remain assigned to the same edges and surfaces even if the work table is rotated to another configuration. The front edge 68 of the work table 50 means the edge that is distal to the sliding hinge 40 when the work table 50 is in the substantially horizontal working configuration 64. The back edge 66 means the edge of the work table 50 that is opposite to the front edge 68 and that faces the wall 90 when the work table 50 is in the substantially horizontal working configuration 64. The work surface 28 is a substantially planar surface of the work table 50 that is farthest away from the floor 92 when the work table 50 is in a substantially horizontal working configuration 64. The underside 78 of the work table 50 means the surface opposite the work surface 28. It is to be understood that a work table 50 that sags from the weight of the work table 50 or a load placed on the work table 50 may still have a substantially planar work surface according to the present disclosure.

Figure 12:
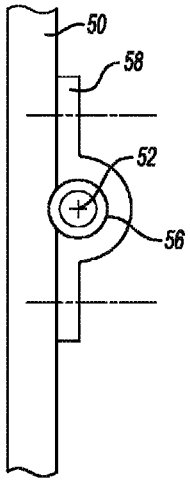
FIG. 12 is a side view of an example of a keeper according to the present disclosure.
Figure 13:
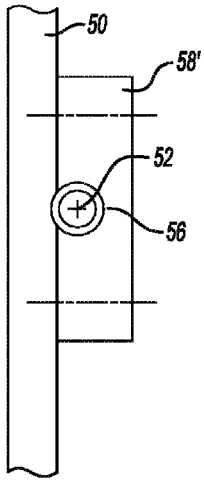
FIG. 13 is a side view of another example of a keeper according to the present disclosure.
Figure 14:
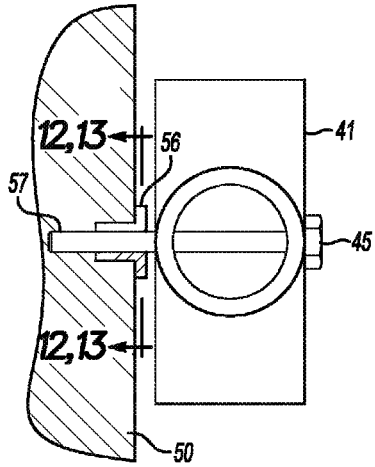
FIG. 14 is a cross-sectional view of an example of a hinge pin engaging a bushing in a work table according to the present disclosure.

Referring to FIGS. 1, 12, 13 and 14, the sliding hinge 40 includes a hinge pin 45 protruding substantially horizontally from the hinge body 41 wherein the hinge pin 45 has a distal end 57 opposite the hinge body 41 to matingly engage a complementary socket 52 disposed on a work table 50. FIG. 12 is a side view showing the side edge of the work table 50 as indicated by the view arrows in FIG. 14. A metal or plastic keeper 58 is shown in FIG. 12 attached to the work table 50. FIG. 13 is a similar side view to FIG. 12, with a different shaped keeper 58' that could be made, for example, from a block of wood. As shown in FIGS. 12 and 13, a keeper 58 may be fixedly attached to the work table 50 to define at least a portion of the complementary socket 52. A bushing 56 may be disposed in the work table 50 or between the work table 50 and the keeper 58 to define the complementary socket 52. The bushing 56 may be formed from a durable plastic or metal material to reduce wear between the hinge pin 45 and the complementary socket 52.

Examples of the present disclosure may include a cleat 24 that may be selectively attachable to the vertical wall 90 to support the work table 50 substantially at a midpoint along the back edge 66 of the work table 50 when the work table 50 is in the working configuration 53.

As depicted in FIG. 1, at least one roller 80 may be disposed on the work table to rollingly contact the floor 92 and separate the work table 50 from the floor 92 when the work table 50 is in a collapsed position 49 and a stowed configuration 55 and when the work table 50 is moved between the collapsed position 49 and the stowed configuration 55.

As depicted in FIG. 1, a manipulator 82 may be disposed substantially adjacent to a front edge 68 of the work table 50. The manipulator 82 is a handle 84 to receive a lifting force 86 and has a pedal position 88 to receive a stowing force (indicated in FIG. 1 by the large horizontal arrow near foot 96) from a foot 96 and substantially prevent the foot 96 from marring and/or soiling the work table 50. The manipulator 82 depicted in FIG. 1 is a handle 84 fixed to a work surface 28 of the work table 50. As shown in the example depicted in FIG. 1, the handle 84 does not move relative to the work table 50, so the manipulator 82 is in the pedal position 88 at all times. In other examples that will be described below, the manipulator 82 may be movable relative to the work table 50 to present a clear work surface 28 when then work table 50 is in the working configuration 53.

As used herein, the collapsed position 49 is a stable orientation of the work table 50 at an angle below the working configuration 53 wherein the front edge 68 of the work table 50 rests substantially against the floor 92 and the sliding hinge 40 is in contact with the gravity stop 46. It is to be understood that the roller 80 may intervene between the front edge 68 and the floor 92. As used herein, a front edge 68 of the work table 50 that has a wheel intervening between the front edge 68 and the floor 68 rests substantially against the floor 92. A stable orientation of the work table 50 means that the work table 50 will remain in the orientation without requiring additional energy to keep it in the orientation. The work table 50 is not easily jarred out of the stable orientation by vibration or an inadvertent nudge. The stowed configuration 55 is also a stable orientation of the work table 50. In examples of the present disclosure, the stowed configuration 55 is an orientation of the work table 50 within about 10 degrees of vertical with a front edge 68 closer to the vertical wall 90 than a back edge 66. Without being held to any theory, it is believed that energy must be applied to the work table 50 to move it from the stowed configuration 55 to a vertical position by lifting a center of gravity of the work table 50. It is noted that because of the kinematic arrangement disclosed herein, the potential energy of the work table 50 is higher in the vertical position than the stowed configuration 55 and the collapsed position 49. Although the work table 50 may be balanced in a vertical position, it is believed that the work table 50 may be easily jarred toward the collapsed position 49 from the vertical position and may tend to fall to the collapsed position 49 without directly applying energy. For example, vibration from a truck passing near a residence may provide enough energy to cause the work table 50 in the residence to fall from the vertical position to the collapsed position 49. Since the stowed configuration 55 is at a lower potential energy state than the vertical position, the work table 50 will tend to stay in the stowed configuration 55 until the work table 50 is pulled through the vertical position toward the collapsed position (i.e. by pulling on the manipulator 82). In examples of the present disclosure, a latch, hook, strap, chock or other retention device (not shown) may be used to prevent the work table from falling to the collapsed position 49.

FIG. 1 depicts an example of stowing the work table 50 according to the present disclosure. The work table 50 may be moved from the collapsed position 49 to the stowed configuration 55 by applying a horizontal force to the manipulator 82. In examples of the present disclosure, the horizontal force may be applied by pressing with a foot 96. It is to be understood that the foot 96 may apply a force with components in directions other than horizontal as long as the overall effect of the force applied by the foot 96 is to urge the work table 50 toward the stowed configuration 55. Without being held bound to any theory, it is believed that the roller 80 and the bearing 42 of the sliding hinge 40 guide the work table into the stowed configuration 55 and substantially reduce friction that would otherwise resist movement of the work table 55.

Examples of the support fixture 10 of the present disclosure may be sized to accommodate work tables 50 having a large range of sizes. For example, a work table 50 may be about the size of a standard 4 ft (foot)×8 ft sheet of ¾ inch plywood. Another work table may be about the size of a half of the standard sheet of plywood. The work table 50 may be longer or shorter and thinner or wider. The work table 50 may be made from any material suitable for a table including wood, laminated wood, plastic, metal, stone, ceramic, leather, fabric, and other similar materials. The work table 50 may be a single sheet of material, or may be a frame with an overlay material. The work table may be a grill, or wire rack.

Figure 3:
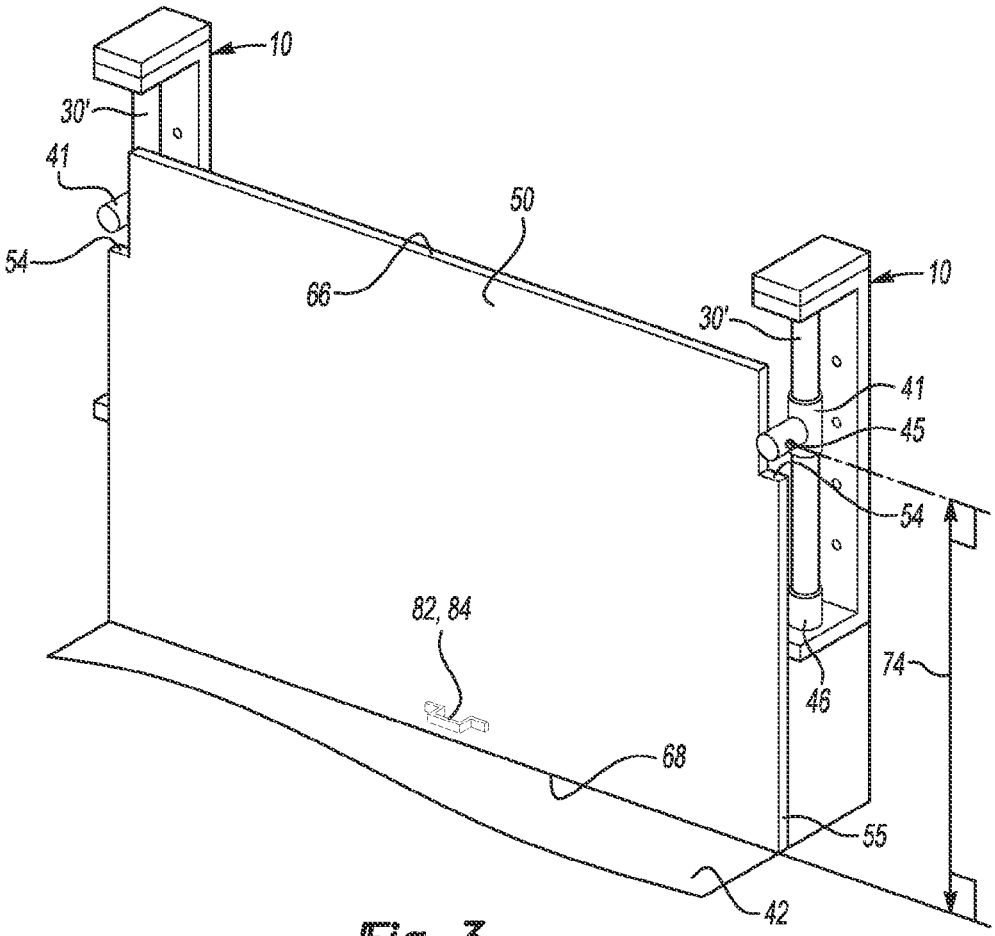
FIG. 3 is a semi-schematic perspective view of an example of the present disclosure depicting the work table in a stowed configuration.
Figure 4:
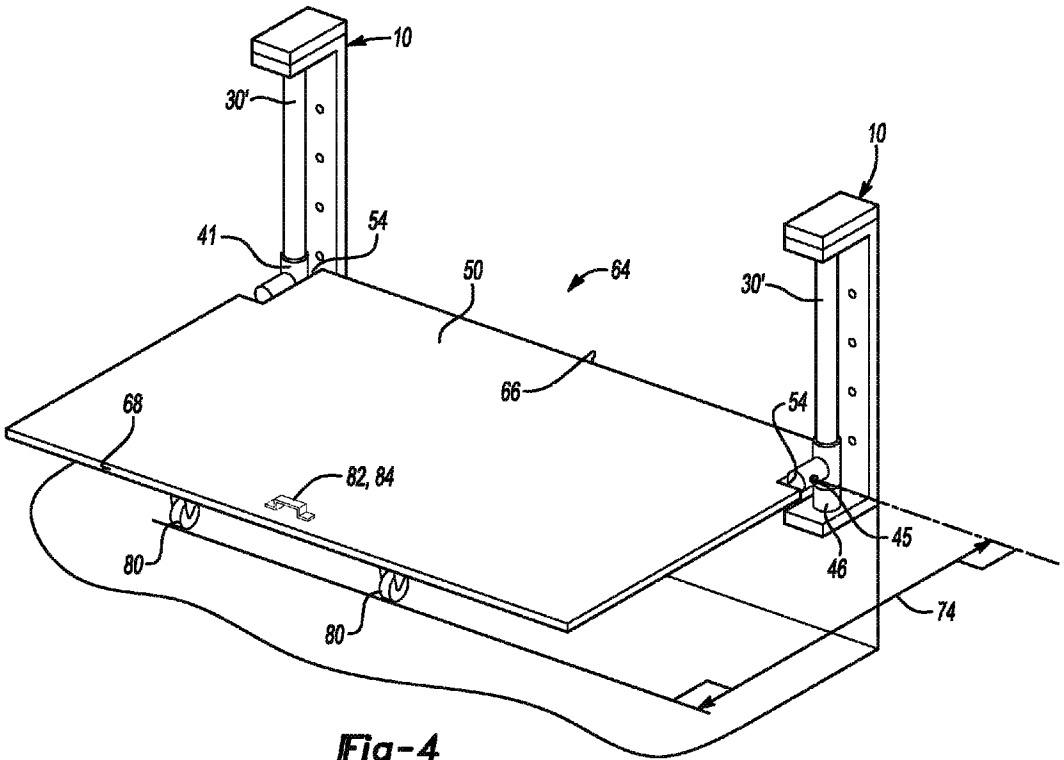
FIG. 4 is a semi-schematic perspective view of an example of the present disclosure depicting the work table in a working configuration.

When the work table is in the working configuration 53 a vertical range distance 21 between a top of the vertical guide 70 and a top of the sliding hinge 72 is at least equal to a mathematical difference between a swing depth 74 of the work table 50 and a distance 76 between the hinge pin 45 and the floor 92 with the sliding hinge 40 in the working position 44. The vertical range distance 21 is sufficient clearance for the amount that the sliding hinge 40 moves up when the work table 50 is moved from the working configuration 53 through vertical to the stowed configuration 55. As used herein, the swing depth 74 of the work table 50 is the greater of the shortest distance between the hinge pin 45 and the front edge 68 of the work table 50 or the longest distance between the hinge pin 45 and a line parallel to the hinge pin 45 that is tangent to the roller 80. The swing depth 74 is illustrated in FIGS. 3 and 4. In FIG. 3, the swing depth 74 is measured from the front edge 68. In FIG. 4, the swing depth 74 is measured from the roller 80. It is to be understood that the swing depth may include additional clearance in the vertical range distance 21 to accommodate the amount that the rollers lift the work table 50 off of the floor 92. (See FIG. 1, where the rollers 80 lift the work table 50 slightly off of the floor 92.) It is to be understood that according to the present disclosure, the work table 50 is supported by the floor 92 in the stowed configuration 55.

FIG. 1 depicts an example of the present disclosure to support the work table 50 in a substantially horizontal working configuration 64. The work table 50 is supported in the working configuration 53 by the brackets 20 and by a front support (not shown). It is to be understood that the front support may be a collapsible leg (not shown) that is attached to the work table. Any support may be used to support the work table 50 and prevent it from falling to the collapsed position 49. For example, a saw horse (not shown) may be used to support the work table 50. A strut (not shown) may be attached between the wall 90 and the work table 50 to hold the work table 50 in the working configuration.

Figure 2:
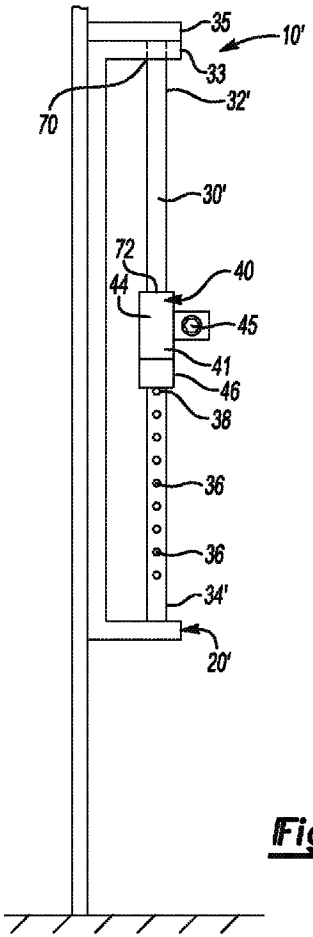
FIG. 2 is a semi-schematic side view of another example of the present disclosure.

FIG. 2 is a semi-schematic side view of another example of the present disclosure. The work surface stowage and support fixture 10' includes a vertical guide 30' with a plurality of spaced index apertures 36 to matingly receive an adjustment pin 38 (see FIG. 7). The adjustment pin 38 may be a dowel or similar pin to be inserted into a selected index aperture 36 and to support the gravity stop 46. The example depicted in FIG. 2 allows the working position 44 of the sliding hinge 40 to be adjusted. For example, a work table 50 may be configured to a working configuration 53 with a convenient height for a standing user or a sitting user. The height may be adjusted by installing the adjustment pin 38 in a selected index aperture 36. In another example, the work table 50 may be a drawing board with a working configuration 53 having the front edge 68 lower than the back edge 66. In the drawing board example, the angle of the drawing board may be adjusted to any angle from about horizontal to about 45 degrees below horizontal.

FIG. 3 is a semi-schematic perspective view of an example of the present disclosure depicting the work table 50 in a stowed configuration 55. FIG. 4 is a semi-schematic perspective view of the example depicted in FIG. 3 showing the work table 50 in the substantially horizontal working configuration 64. When the work table is in a substantially horizontal working configuration 64, the work table 50 has a back edge 66 facing the vertical wall 90, and a front edge 68 distal to the back edge 66. In the example, a notch 54 is defined in the back edge 66 to prevent contact between the work table 50 and the hinge body 41 during rotation of the work table 50 about the hinge pin 45 (see FIG. 1).

Figure 5:
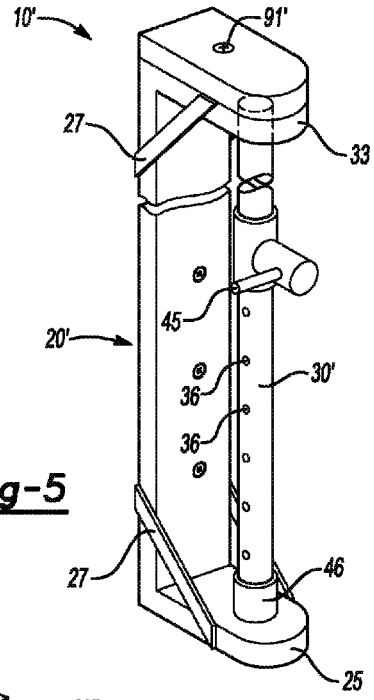
FIG. 5 is a semi-schematic perspective view of an example of a support fixture of the present disclosure.

FIG. 5 is a semi-schematic perspective view of an example of a support fixture 10' of the present disclosure. As shown in FIG. 5, a gusset 27 may be included in the bracket 20' to increase the strength of the interface between the upper horizontal flange 33 compared to the cantilever configuration depicted, for example, in FIG. 2. The lower horizontal flange 25 may similarly be supported by a gusset 27.

Figure 6:
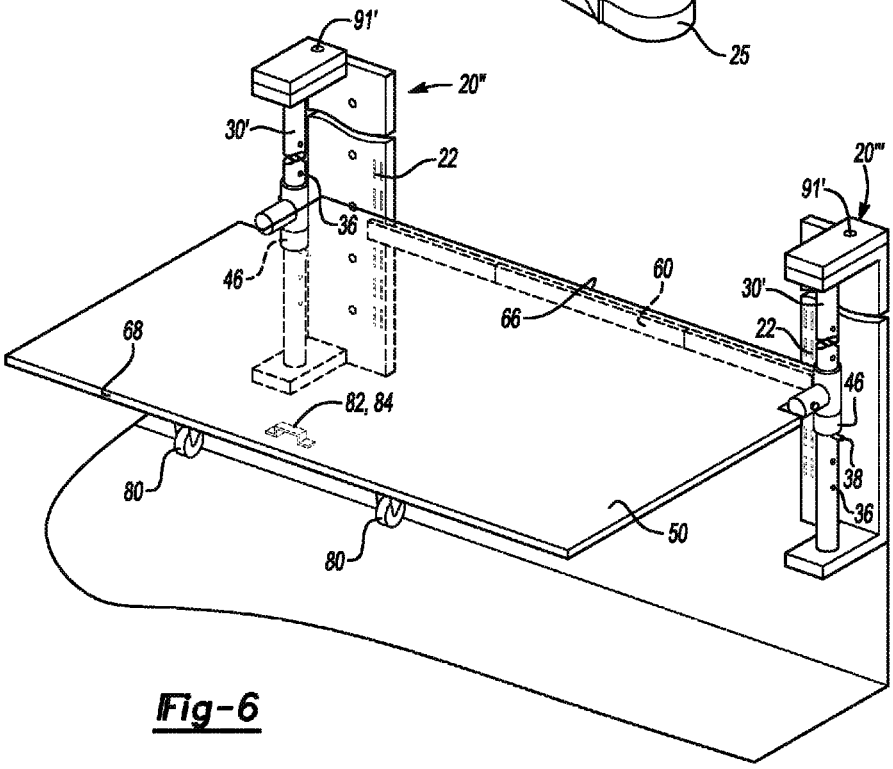
FIG. 6 is a semi-schematic perspective view of yet another example of the present disclosure.
Figure 7:
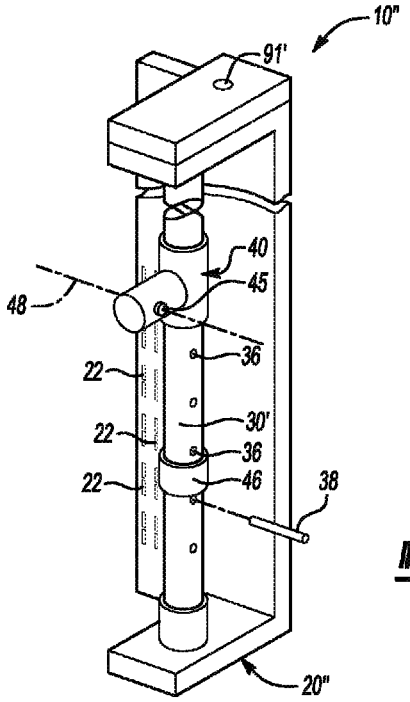
FIG. 7 is a semi-schematic perspective view another example of a support fixture of the present disclosure.
Figure 8:
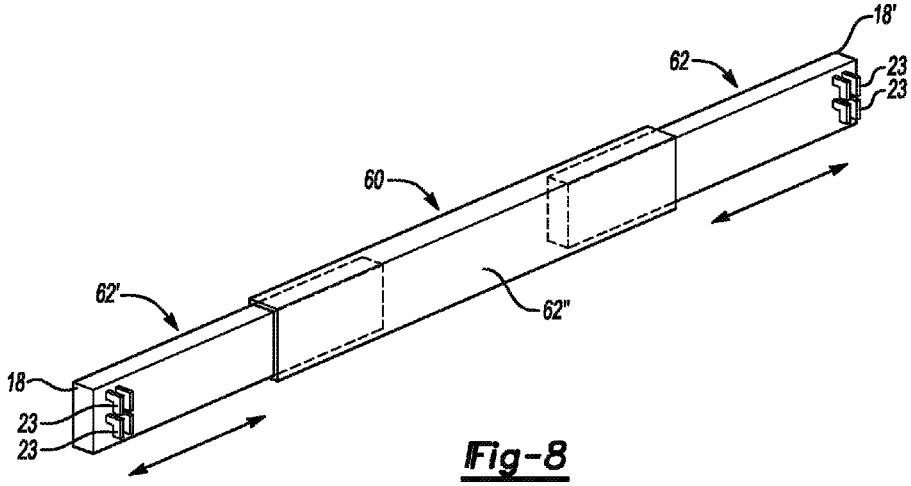
FIG. 8 is a semi-schematic perspective view of an example of a support beam of the present disclosure.

FIGS. 6, 7 and 8 are semi-schematic perspective views of yet another example of the present disclosure. A support beam 60 is shown providing support to the back edge 66 of the work table 50. A simply supported work table 50 may sag if used to support heavy objects. The support beam 60 may reduce the amount that the work table 50 may sag. It is to be understood that the work table 50 may be sized to reduce sag without a support beam, however the disclosed support beam 60 may facilitate the use of a thinner, lighter work table 50. The support beam 60 is adjustably attached to the brackets 20", 20'". Bracket 20" is substantially a mirror image of bracket 20'". Each bracket 20", 20'" includes a plurality of mounting slots 22 to adjustably attach the support beam 60 via complementary tabs 23 disposed at ends 18, 18' of the support beam 60. Each mounting slot 22 of the plurality of mounting slots is associated with each index aperture 36 of the plurality of spaced index apertures to selectively cause the support beam 60 to abut and support the work table 50 for each of the spaced index apertures 36. It is to be understood that in examples having a plurality of tabs 23 disposed at the ends 18, 18', the plurality of tabs 23 align with a set of corresponding mounting slots 22 to hold the support beam 60 in a position to support the work table 50 for each selectable index aperture 36. The support beam 60 may include a plurality of telescopingly interfacing segments 62, 62', 62" to adjustably attach to the bracket 20" and the mirror image bracket 20'" horizontally spaced on the vertical wall 90 from the bracket 20". Reference numeral 48 in FIG. 7 depicts an axis through the center of hinge pin 45.

Figures 9, 10, 11:
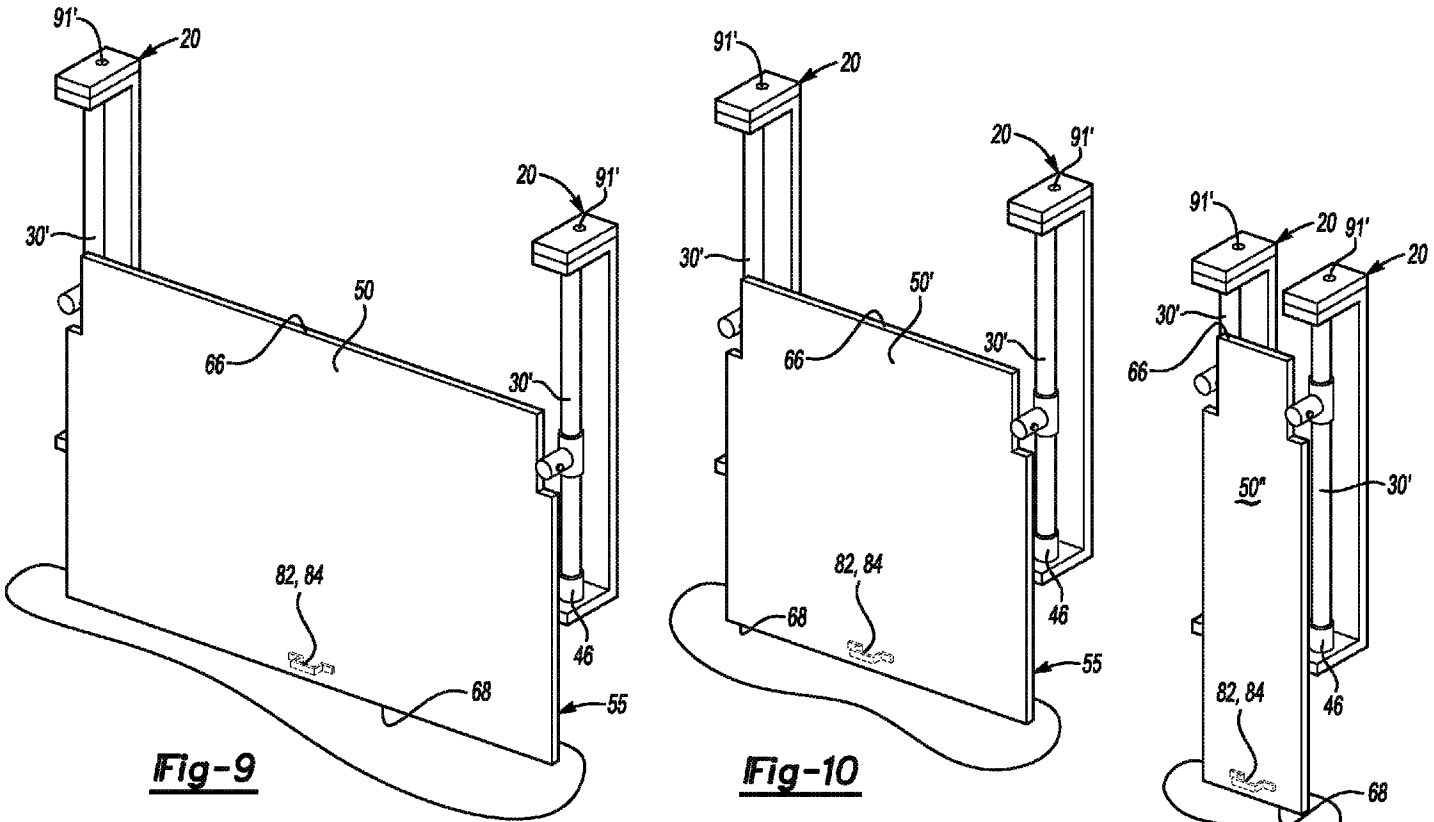
FIG. 9 is an example of the present disclosure with a work table depicted in the stowed configuration.
FIG. 10 is an example of the present disclosure with a work table depicted in the stowed configuration and the work table is narrower than the work table depicted in FIG. 9.
FIG. 11 is an example of the present disclosure with a work table depicted in the stowed configuration and the work table is narrower and taller than the work table depicted in FIG. 10.

FIG. 9 is an example of the present disclosure with a work table 50 depicted in the stowed configuration 55. FIG. 10 is an example of the present disclosure with a work table 50' depicted in the stowed position 55 and the work table 50' is narrower than the work table 50 depicted in FIG. 9. FIG. 11 is another example of the present disclosure with a work table 50" depicted in the stowed position 55 and the work table 50" is narrower and taller than the work table 50' depicted in FIG. 10. FIGS. 9, 10 and 11 together show that a bracket 20 according to the present disclosure may accommodate work tables having a large range of sizes. It is therefore possible to realize economies of scale in manufacturing, packaging, shipping, and marketing of brackets 20 according to the present disclosure.

Figure 15:
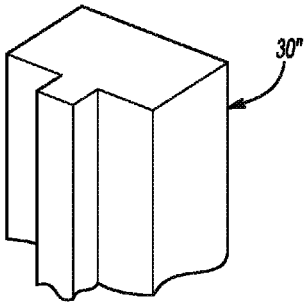
FIG. 15 is a perspective view of an example of a vertical guide having a T-shaped cross-section according to the present disclosure.
Figure 16:
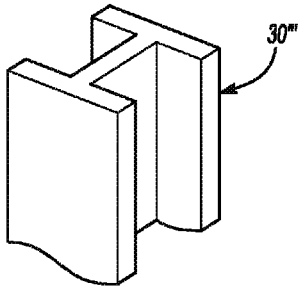
FIG. 16 is a perspective view of an example of a vertical guide having an I-shaped cross-section according to the present disclosure.
Figure 17:
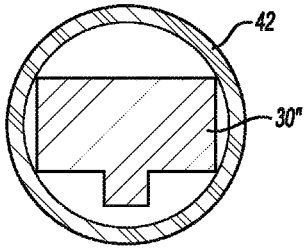
FIG. 17 is a semi-schematic cross-sectional view depicting a round bearing engaging a vertical support that has a T-shaped cross-section.

FIG. 15 is a perspective view of an example of a vertical guide 30" having a T-shaped cross-section according to the present disclosure. FIG. 16 is a perspective view of an example of a vertical guide 30'" having an I-shaped cross-section according to the present disclosure. The bearing 42 of the sliding hinge 40 may have a round cross section that circumscribes a cross-section of the vertical guide 30, 30', 30", 30'". Regardless of whether the cross-section of the vertical guide 30, 30', 30", 30'" is round or some other shape, the bearing 42 may have a cross-section that defines a circumscribed circle around the cross-section of the vertical guide as depicted in FIG. 17. Since the bearing 42 substantially prevents horizontal relative motion between the bearing 42 and the vertical guide 30, 30', 30", 30'" while remaining vertically translatable along the vertical guide 30, 30', 30", 30'" between a working position 44 and a stowed position 43, clearance between the bearing 42 and the vertical guide 30, 30', 30", 30'" may be a sliding fit. It is to be understood that a loose fit between the vertical guide 30, 30', 30", 30'" and the bearing 42 will generally not cause diminished functionality of the sliding hinge. However, if the fit between the vertical guide 30, 30', 30", 30'" and the bearing 42 is too tight, (for example, an interference fit) the bearing 42 may bind on the vertical guide 30, 30', 30", 30'" and increase the amount of effort required to stow the work table 50.

Figure 18:
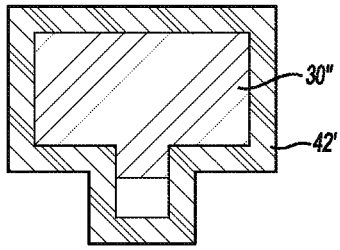
FIG. 18 is a semi-schematic cross-sectional view depicting a complementary bearing engaging a vertical support that has a T-shaped cross-section according to the present disclosure.

FIG. 18 is a semi-schematic cross-sectional view depicting a complementary bearing 42' engaging a vertical support 30" that has a T-shaped cross-section according to the present disclosure. The bearing 42' may be shaped to complement a vertical support 30, 30', 30", 30'" having any cross-sectional shape.

Figure 19:
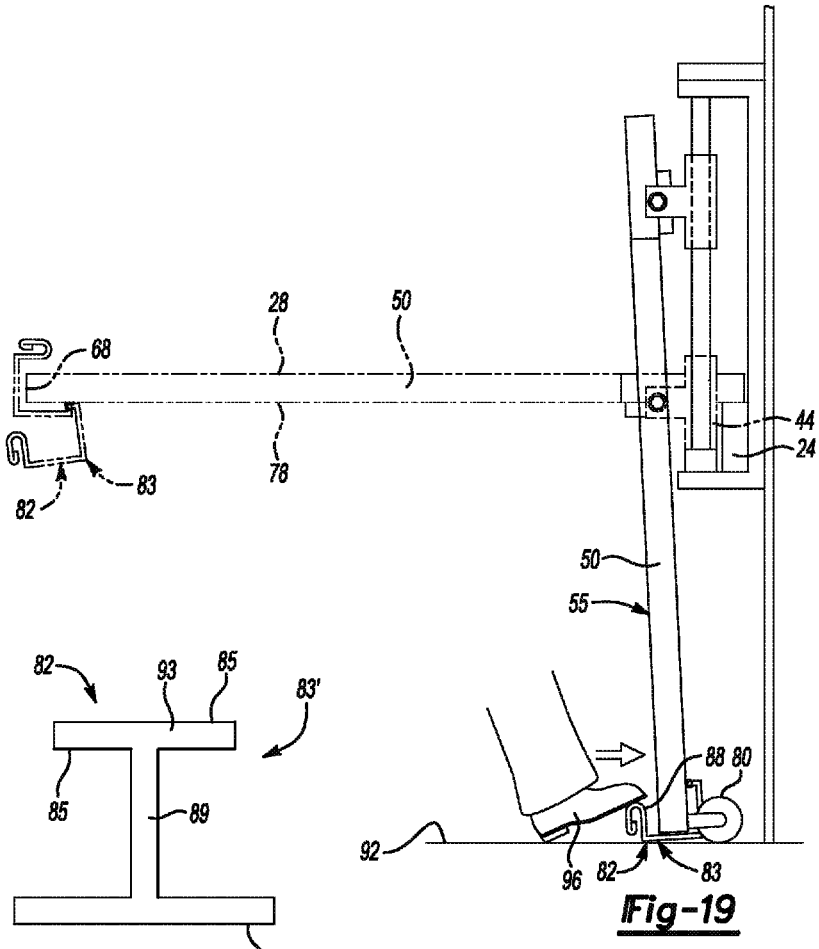
FIG. 19 is a semi-schematic view depicting an example of a swing-away handle-pedal attached to a work table according to the present disclosure.

FIG. 19 is a semi-schematic view depicting a swing-away handle-pedal 83 attached to the work table 50 according to the present disclosure. The swing away handle-pedal 83 is an example of a manipulator 82 according to the present disclosure. The swing-away handle-pedal 83 may be attached to an underside 78 of the work table 50. In the example shown in FIG. 19, the swing-way handle-pedal 83 is rotatable to the underside 78 of the work table 50 when the work table 50 is in the working configuration. The swing-away handle-pedal 83 is urged by the floor 92 into the pedal position 88 when the work table 50 is in the collapsed position 49 and a stowed configuration 55, and when the work table 50 is moved between the collapsed position 49 and the stowed configuration 55. The roller 80 is not shown in the horizontal configuration of FIG. 19 to provide a clear illustration of the movement of the swing-away handle-pedal 83.

Figure 20:
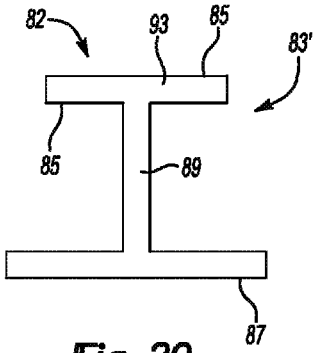
FIG. 20 is a semi-schematic view depicting a T-shaped swing-away handle-pedal according to the present disclosure.

FIG. 20 is a semi-schematic view depicting a T-shaped swing-away handle-pedal 83' according to the present disclosure. The T-shaped swing away handle-pedal 83' is an example of a manipulator 82 according to the present disclosure. The T-shaped swing-away handle-pedal 83' includes journals 85 at opposite ends of a shaft 93 that mate with complementary bearings (not shown) fixed to the underside 78 of the work table 50 (see FIG. 19). A substantially rigid crossbar 87 may be rigidly attached to a substantially rigid spar 89. As shown in FIG. 20, the spar 89 may be a single spar located near the center of the shaft 93 and the crossbar 87. In other examples there may be more than one spar (not shown). For example a spar may be attached at the ends of the crossbar. It is to be understood that the spar 89 may be bent similarly to the swing away pedal 83 shown in FIG. 19 to reach around the work table 50. Bending of spar 89 is not visible in the view shown in FIG. 20. As shown in FIG. 19, when the swing-away handle-pedal 83 contacts the floor 92, the swing-away handle-pedal 83 rotates about the shaft 93 such that the crossbar 87 is accessible for applying force by a foot 96. When work table 50 is in the stowed configuration 55, the crossbar 87 may be grasped to apply a pulling force to urge the work table 50 out of the stowed configuration 55. It is to be understood that when the work table 50 is between the vertical position and the collapsed position 49, gravity may cause the work table 50 to move toward the collapsed position 49 without additional force being applied to the crossbar 87. The work table 50 may be lifted from the collapsed position 49 to the working configuration 53 by applying a lifting force to the crossbar 87. When the swing-away handle-pedal 83 is released and the work table 50 is supported in the working configuration 53, the swing-away handle-pedal 83 may rotate under the work table 50 under the influence of gravity thereby presenting the work surface 28 without a handle protruding from the work surface 28.

Figure 21:
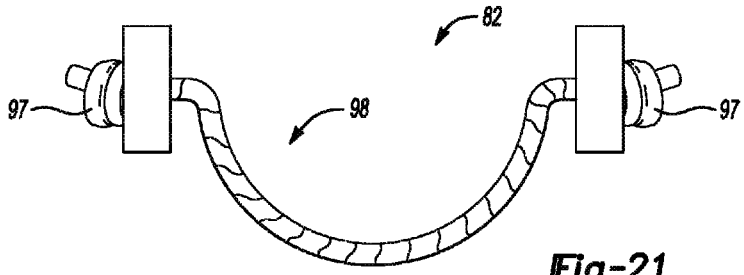
FIG. 21 is a semi-schematic view depicting a rope handle-pedal according to the present disclosure.

FIG. 21 is a semi-schematic view depicting a rope handle-pedal 98 according to the present disclosure. The rope handle-pedal 98 is an example of a manipulator 82 according to the present disclosure. The rope handle-pedal 98 includes knots 97 at opposite ends of a portion of rope that is fixed to the underside 78 of the work table 50 (see FIG. 19). When the rope handle-pedal 98 contacts the floor 92, the rope handle-pedal 98 flexes around the front edge 68 of the work table 50 and is accessible for applying force by a foot 96. The rope handle-pedal 98 may act as a cushion between the foot 96 and the work surface 50 thereby preventing the foot 96 from soiling the work surface 28. When work table 50 is in the stowed configuration 55, the rope handle-pedal 98 may be grasped to apply a pulling force to urge the work table 50 out of the stowed configuration 55. The work table 50 may be lifted from the collapsed position 49 to the working configuration 53 (see FIG. 1) by applying a lifting force to the rope handle-pedal 98. When the rope handle-pedal 98 is released and the work table 50 is in the working configuration 53, the rope handle-pedal 98 may rotate under the work table 50 under the influence of gravity thereby presenting the work surface 28 without a handle protruding from the work surface 28. In another example, the rope handle-pedal 98 may be manually stowed under the work table 50.

Examples of the present disclosure include a kit that includes the support fixture 10, 10' as described above. The kit may further include at least one roller 80 to dispose on the work table to rollingly contact the floor and separate the work table 50 from the floor 92 when the work table 50 is in a collapsed position 49 and a stowed configuration 55 and when the work table 50 is moved between the collapsed position 49 and the stowed configuration 55. The kit may also include a manipulator 82 to dispose substantially adjacent to a front edge 68 of the work table 50 wherein the manipulator 82 is a handle 84 to receive a lifting force and has a pedal position 88 to receive a stowing force from a foot 96 and substantially prevent the foot 96 from marring and soiling the work table 50 and wherein, when the work table 50 is in a substantially horizontal working configuration, the back edge 66 of the work table 50 faces the vertical wall, and the front edge 68 of the work table 50 is distal to the back edge 66. The kit may still further include the keeper 58 described above to be fixedly attached to the work table 50 to define at least a portion of the complementary socket 52.

While several examples have been described in detail, it will be apparent to those skilled in the art that the disclosed examples may be modified. Therefore, the foregoing description is to be considered non-limiting.

What is claimed is:

1. A work table stowage and support fixture, comprising:

a bracket to fixedly mount to a substantially vertical wall;

a vertical guide having a top end fixed to the bracket and a bottom end distal to the top end fixed to the bracket;

a sliding hinge having:

a hinge body;

a bearing disposed on the hinge body to engage the vertical guide and to substantially prevent horizontal relative motion between the bearing and the vertical guide wherein the bearing is vertically translatable along the vertical guide between a working position and a stowed position; and a hinge pin protruding substantially horizontally from the hinge body wherein the hinge pin has a distal end opposite the hinge body to matingly engage a complementary socket disposed on a work table; and a gravity stop disposed on the bracket to vertically support the sliding hinge when the work table is in a working configuration corresponding to the working position, wherein the vertical guide has a plurality of spaced index apertures to matingly receive an adjustment pin; the bracket further includes a plurality of mounting slots to adjustably attach a support beam; and each mounting slot of the plurality of mounting slots is associated with each index aperture of the plurality of spaced index apertures to selectively cause the support beam to abut and support the work table for each of the spaced index apertures.

2. The support fixture as defined in claim 1 wherein the support beam includes a plurality of telescopingly interfacing segments to adjustably attach to the bracket and an other bracket horizontally spaced on the vertical wall from the bracket.

3. The support fixture as defined in claim 1 wherein the vertical guide is a rod or tube.

4. The support fixture as defined in claim 1 wherein the bearing is a T-shaped tube connector complementarily sized to surround the vertical guide.

5. The support fixture as defined in claim 1 wherein the vertical guide has a T-shaped or I-shaped horizontal cross-section.

6. The support fixture as defined in claim 1 wherein when the work table is in a substantially horizontal working configuration, the work table has a back edge facing the vertical wall, a front edge distal to the back edge, and a notch defined in the back edge to prevent contact between the work table and the hinge body during rotation of the work table about the hinge pin.

7. The support fixture as defined in claim 1 wherein when the work table is in the working configuration, a distance between a top of the vertical guide and a top of the sliding hinge is at least equal to a mathematical difference between a swing depth of the work table and a distance between the hinge pin and a floor with the sliding hinge in the working position.

8. The support fixture as defined in claim 1, further comprising:

a bushing disposed in the work table;

wherein the bushing defines the complementary socket.

9. The support fixture as defined in claim 1, further comprising a keeper fixedly attached to the work table to define at least a portion of the complementary socket.

10. The support fixture as defined in claim 1 wherein:

the working configuration is an orientation of the work table from about horizontal to about 45 degrees below horizontal;

the stowed position is a stable orientation of the work table within about 10 degrees of vertical with a front edge closer to the vertical wall than a back edge; and when the work table is in a substantially horizontal working configuration, the back edge of the work table faces the vertical wall, and the front edge of the work table is distal to the back edge.

11. An apparatus for mounting and storing a work table, comprising:

the support fixture as defined in claim 1;

at least one roller disposed on the work table to rollingly contact the floor and separate the work table from the floor when the work table is in a collapsed position and a stowed configuration and when the work table is moved between the collapsed position and the stowed configuration; and a manipulator disposed substantially adjacent to a front edge of the work table wherein the manipulator is a handle to receive a lifting force and has a pedal position to receive a stowing force from a foot and substantially prevent the foot from marring and soiling the work table and wherein, when the work table is in a substantially horizontal working configuration, the back edge of the work table faces the vertical wall, and the front edge of the work table is distal to the back edge.

12. The apparatus as defined in claim 11 wherein the collapsed position is a stable orientation of the work table at an angle below the working configuration wherein the front edge of the work table rests substantially against the floor.

13. The apparatus as defined in claim 11 wherein:

the manipulator is to attach to an underside of the work table;

the manipulator is translatable or rotatable to the underside of the work table when the work table is in the working configuration; and the manipulator is urged by the floor into the pedal position when the work table is in a collapsed position and a stowed configuration, and when the work table is moved between the collapsed position and the stowed configuration.

14. The apparatus as defined in claim 13 wherein the manipulator comprises a rope.

15. The apparatus as defined in claim 13 wherein the manipulator comprises:

a substantially rigid crossbar to be both the handle and the pedal; and a substantially rigid spar attached to the crossbar to rotatably attach to the underside of the work table.

16. The apparatus as defined in claim 11, further comprising a cleat selectively attachable to the vertical wall to support the work table substantially at a midpoint along a back edge of the work table facing the vertical wall when the work table is in the working configuration.

17. A work table stowage and support fixture kit, comprising:

the support fixture as defined in claim 1;

at least one roller to dispose on the work table to rollingly contact the floor and separate the work table from the floor when the work table is in a collapsed position and a stowed configuration and when the work table is moved between the collapsed position and the stowed configuration;

a manipulator to dispose substantially adjacent to a front edge of the work table wherein the manipulator is a handle to receive a lifting force and has a pedal position to receive a stowing force from a foot and substantially prevent the foot from marring and soiling the work table and wherein, when the work table is in a substantially horizontal working configuration, the back edge of the work table faces the vertical wall, and the front edge of the work table is distal to the back edge; and a keeper to be fixedly attached to the work table to define at least a portion of the complementary socket.

* * * * *